United States Patent [19]

Ishii et al.

[11] Patent Number: 4,494,336

[45] Date of Patent: Jan. 22, 1985

[54] WIRE-TYPE DOOR WINDOW REGULATOR FOR AN AUTOMOTIVE VEHICLE

[75] Inventors: Kinichi Ishii, Yokohama; Yoshiharu Araki, Tokyo, both of Japan

[73] Assignee: Kabushiki Kaisha Johnan Seisakusho, Japan

[21] Appl. No.: 427,573

[22] Filed: Sep. 29, 1982

[30] Foreign Application Priority Data

Jan. 19, 1982 [JP] Japan ..... 57-6224

[51] Int. Cl.[3] ..... E05F 11/48

[52] U.S. Cl. ..... 49/352; 49/374

[58] Field of Search ..... 49/352, 327, 428, 442, 49/443, 444, 374

[56] References Cited

U.S. PATENT DOCUMENTS 3,427,748 2/1969 Marr ..... 49/352
4,069,617 1/1978 Koike ..... 49/428

FOREIGN PATENT DOCUMENTS 2037224 2/1972 Fed. Rep. of Germany .
3023641 7/1982 Fed. Rep. of Germany .
1448795 9/1976 United Kingdom .

*Primary Examiner*—Kenneth Downey
*Attorney, Agent, or Firm*—McGlew and Tuttle

[57] ABSTRACT

An improved wire-type door window regulator moves a window pane upward and downward relative to a door panel or body panel of an automotive vehicle in accordance with a rotating operation of a crank or electric motor. The wire-type door window regulator comprises: (a) a wire extending along an orbit in which the window pane moves upward and downward; (b) a wire driving mechanism to which the ends of the wire are secured and which winds and unwinds the wire so as to move the window pane to a desired elevation with respect to the door panel (window pane receiving well) according to the rotation thereof; (c) a substantially U-shaped-cross-sectioned guide rail member attached to the door inner panel or body panel and which extends in substantially the same direction as the motion of the window pane, having a longitudinal leg on each side thereof and one longitudinal leg being bent at a right angle to form a flange and the other longitudinal leg being folded backward by press working to form a guide runner; and (d) a mechanism for connecting the window pane to the wire for movement therewith having a substantially U-shaped-cross-sectioned groove matching the guide rubber so as to allow slidably the window pane to slide in the longitudinal direction of the guide rail member, a substantially L-shaped-cross-sectioned groove separate from the substantially U-shaped-cross-sectioned groove engaging the flange of the guide rail member, and a stop member for fixing the wire thereto. Therefore, the window pane can smoothly be moved upward and downward.

6 Claims, 6 Drawing Figures

WIRE-TYPE DOOR WINDOW REGULATOR FOR AN AUTOMOTIVE VEHICLE

BACKGROUND OF THE INVENTION

1. Field of the Invention

The present invention relates generally to a door window regulator for an automotive vehicle, and particularly to a wire-type door window regulator applicable to a vehicle door wherein a window pane guiding arrangement of the door window regulator is improved.

2. Description of the Prior Art

A conventional door window regulator for an automotive vehicle comprises: (a) a wire stretched along a line which lies in the plane of a window pane of a vehicle door having a predetermined radius of curvature parallel to the axis of movement thereof; (b) a guide rail attached to, e.g., a door inner panel so as to extend parallel to the axis of movement of the window pane; (c) a bracket to one surface of which the lower edge of the window pane is fixed and to the other surface of which the wire is fixed and the guide rail is engaged so as to allow the bracket to slidably move upward and downward therealong; (d) two pulleys provided at upper and lower ends of the guide rail, respectively; and (e) a drum located to one side of the guide rail around which the wire extending around both pulleys is wound so that the wire is wound around the drum or reeled in and out by the drum is rotated by means of an attached crank or an electric motor.

In the construction as described hereinabove, for example, when the drum is rotated counterclockwise and the wire is retracted into the drum from the upper pulley, the bracket is accordingly moved upward along the guide rail so that the door window pane is raised. On the other hand, when the drum is rotated clockwise and the wire is retracted into the drum from the lower pulley, the bracket is accordingly moved downward along the guide rail so that the door window pane is lowered.

The conventional window regulator usually uses a guide rail made of an elongated steel plate material having a substantially U-shaped cross section. The U-shaped guide rail is formed by bending the longitudinal edges of the steel strip material at substantially right angles to the rest of the strip. The sides of the U-shaped guide rail constitute longitudinal legs, each being perpendicular to the plane of the window pane. The edge of one longitudinal leg is bent at a substantially right angle to form a flange parallel to the plane of the window pane.

On the other hand, the bracket has a first channel portion at one end thereof into which one of the longitudinal legs of the guide rail is inserted and has a second channel portion at the other end thereof into which the flange of the guide rail is inserted. When the longitudinal leg of the guide rail is inserted into the first channel portion, the vertical displacement of the window pane with respect to the guide rail and the rotational freedom of the window pane about the bracket are restricted. When the flange of the guide rail is inserted slidably into the second channel portion of the bracket via an elastic material such as a leaf spring, the displacement of the window pane with respect to the plane of the window pane itself is also restricted.

However, there are many drawbacks in the conventional door window regulator as described hereinabove.

For example, if a piece of hot-rolled steel plate 2 mm thick is used for the material of the guide rail, the error in thickness of the longitudinal leg and flange portion of the guide rail will be 0.4 millimeters (2 mm×(20/100)) since the tolerance in the thickness of such a piece of hot-rolled steel plate is 20 percent. On the other hand, if a piece of cold-worked polished steel plate 2 mm thick is used for the material of the guide rail plate, the error in thickness thereof will be 0.28 mm (2 mm×(14/100)=0.28 mm) since the tolerance in the thickness of such a relatively high precise piece of cold-worked polished steel plate is 14 percent.

Therefore, although the error between the dimensions of the flange of the guide rail and second channel portion can be cancelled by means of the elastic material described above, there will be variations in clearance between the inner and outer surfaces of the longitudinal legs of the guide rail and corresponding surface of the first channel portion of the bracket. Consequently, rotational displacement of the window pane about the bracket may occur so the upward and downward motion of the window pane will not be reliably smooth.

In addition, since some burrs will be produced at the upper edge of the longitudinals leg during processing of the guide rail, and contact with such burrs may damage the second channel portion of the bracket, a separate operation for eliminating such burrs is additionally necessary.

SUMMARY OF THE INVENTION

With the above-described drawbacks in mind, it is an object of the present invention to provide a wire-type door window regulator for an automotive vehicle wherein a window pane arrangement is improved so as to allow a window pane to move smoothly upwards and downwards.

This can be achieved by folding the edge of the longitudinal leg of the guide rail along the surface of the first channel portion of the bracket during the pressing operation to form a curved cross-section portion, both side surfaces of which provide a means for guiding the movement of the bracket and, accordingly, the window pane.

BRIEF DESCRIPTION OF THE DRAWINGS

The features and advantages of the present invention will clearly be appreciated from the foregoing description and accompanied drawings, in which like reference numerals designate corresponding elements and in which.

DETAILED DESCRIPTION OF THE PREFERRED EMBODIMENTS

Reference will hereinafter be made to the attached drawings in order to facilitate understanding of the present invention.

Figure 1:
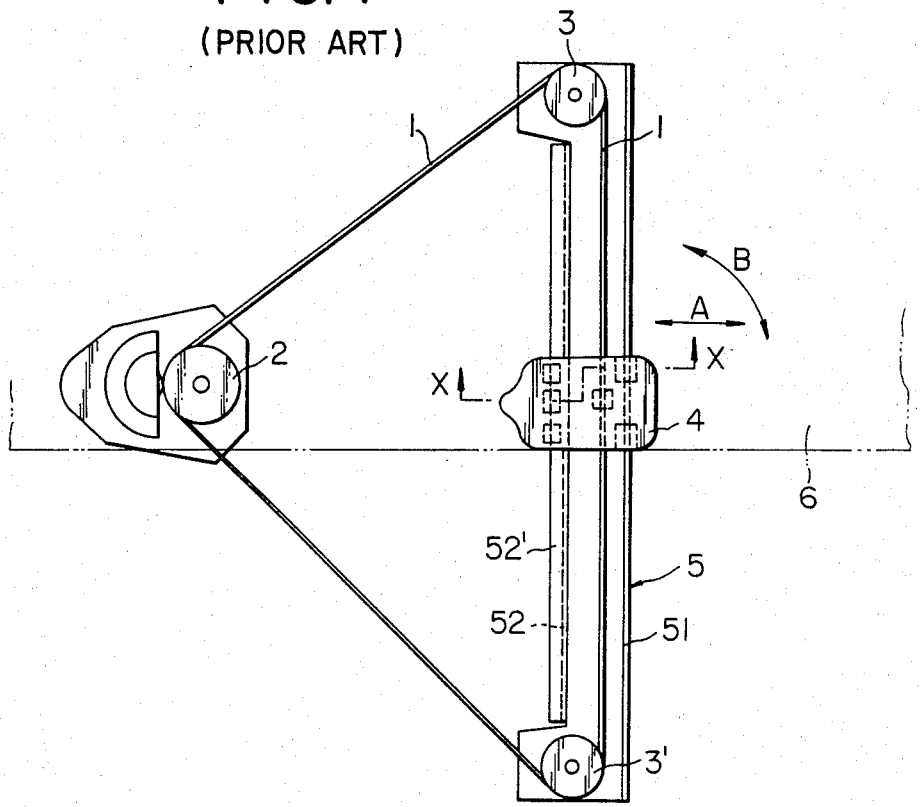
FIG. 1 (PRIOR ART)
FIG. 1 is a front view of a conventional wire-type door window regulator for an automotive vehicle which is installed on a door panel particularly of a left-handed vehicle door.

FIG. 1 shows a conventional wire-type door window regulator for an automotive vehicle, particularly for a left-handed vehicle door as viewed from a driver's seat.

Numeral 1 denotes a wire extending parallel to the direction of movement, normally vertical, of a window pane of a vehicle door and numeral 2 denotes a drum to an axis of which a crank is attached (not shown) and around which the wire is wound, one end of the wire 1 being rolled up counterclockwise and secured to the drum 2 and the other end of the wire 1 being rolled up clockwise and secured to the drum 2. Numerals 3 and 3' denote an upper pulley and lower pulley respectively, the axes of which are fixed near the opposite ends of a guide rail 5. Numeral 4 denotes a bracket, preferably made of a synthetic resin, to one surface of which the center of the lower edge of a window pane 6, indicated by a phantom line, is attached.

When the drum 2 is rotated counterclockwise as viewed from FIG. 1 by means of a crank or electric motor (not shown), the wire 1 stretched around the upper pulley 3 is retracted into the drum 2 and simultaneously the wire 1 stretched around the lower pulley 3' is unwound from the drum 2 so that the bracket 4 is moved upward along the guide rail and accordingly the window pane is raised. It should be noted that an intermediate portion of the wire 1 extending between the upper and lower pulleys 3 and 3' is secured to the bracket 4 as shown in FIG. 2.

Conversely when the drum 2 is rotated clockwise, the wire 1 from the upper pulley 3 is, in turn, unwound from the drum 2 and simultaneously the wire 1 from the lower pulley 3' is retracted into the drum 2 so that the bracket 4 is lowered.

Figure 2:
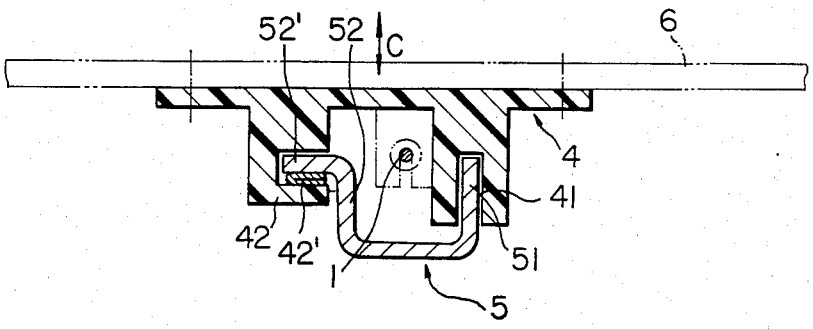
FIG. 2 (PRIOR ART)
FIG. 2 is a cross-sectional view of a guiding arrangement comprising a bracket and guide rail of the conventional wire-type door window regulator taken along the line X—X in FIG. 1.

As shown in FIG. 2, the guide rail 5 made of an elongated steel strip has a substantially U-shaped cross section. Both edges of the guide rail 5 are bent through substantially right angles to form longitudinal legs 51 and 52. The edge of one longitudinal leg 52 is bent through a right angle to form a flange 52'. On the other hand, the bracket 4 has two grooves at the other surface thereof, a first groove 41 slidably engaging the longitudinal leg 51 of the guide rail 5 and a second groove 42 slidably engaging the flange 52' of the guide rail 5 via an elastic material 42' such as a leaf spring so as to prevent the window panel 6 from moving in the arrow-marked direction C in FIG. 2. The engagement of the first groove 41 with the longitudinal leg 51 prevents the window pane 6 from moving in arrow-marked direction A within the plane of the window pane 6 as shown in FIG. 1. The combination of these engagements, furthermore, prevents the window pane 6 from pivotting about the bracket 4 counterclockwise or clockwise as indicated by B of FIG. 1.

Figure 3:
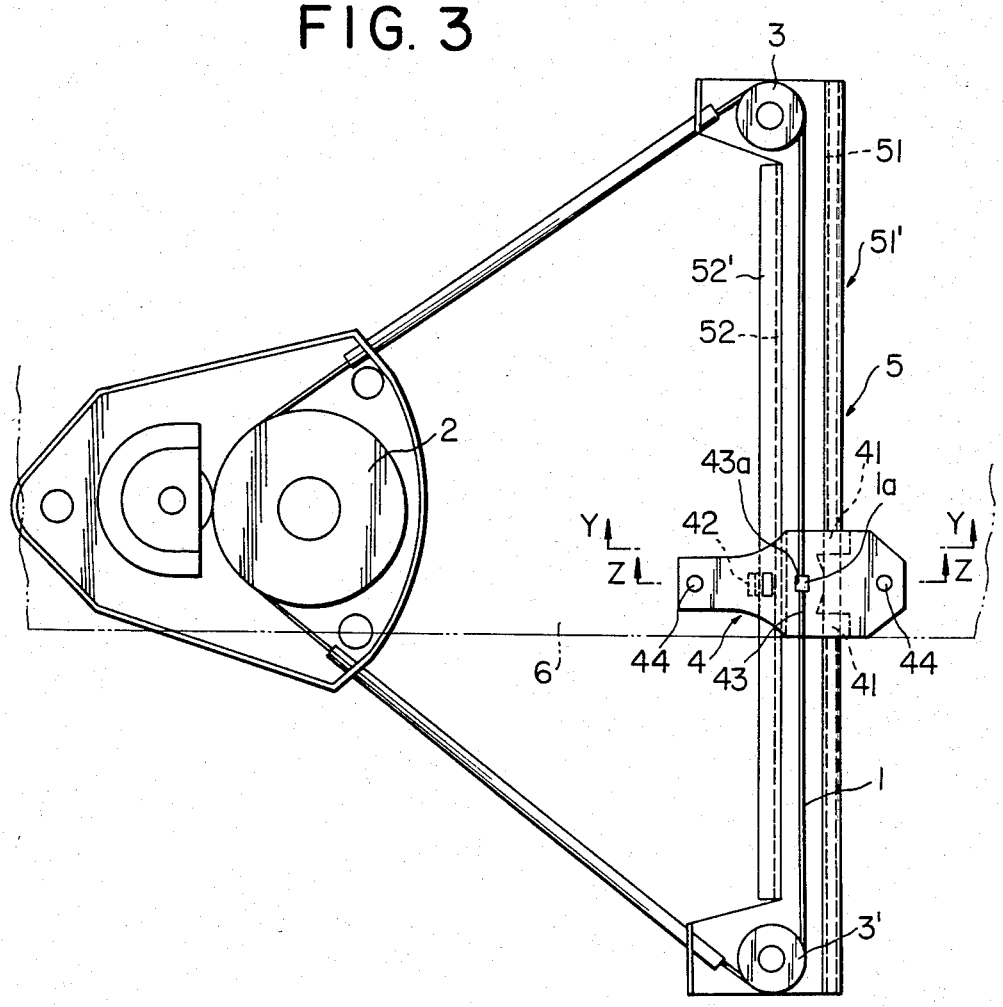
FIG. 3 is a front view of a wire-type door window regulator for an automotive vehicle showing a first preferred embodiment according to the present invention.

FIG. 3 shows a first preferred embodiment according to the present invention particularly applicable to a left-handed vehicle door.

Figure 4:
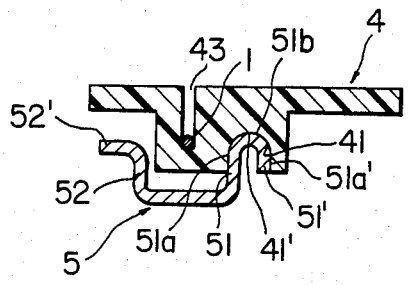
FIG. 4 is a cross-sectional view of the guiding arrangement of the wire-type door window regulator taken along the line Y—Y in FIG. 3.

FIG. 4 shows a cross section of the bracket 4 taken along the line Y—Y of FIG. 3. The edge 51' of the longitudinal leg 51 of the guide rail 5 as shown in FIGS. 3 and 4 is folded backward to form an inverted-U cross section. The outer surface 51*a* of the longitudinal leg 51 and the outer surface 51*a*' of the folded edge 51' of the longitudinal leg 51 constitute a guiding runner of the guide rail 5.

It is well known that the tolerance of a steel plate which undergoes press working is ±0.1 mm (irrespective of thickness of steel plate). If the edge of the longitudinal leg 51 is folded backward to form a runner 51', the tolerance in the width d between the outer surface 51*a* of the longitudinal leg 51 and outer surface 51*a*' is ±0.2 mm overall since the tolerance in each bend is ±0.1 mm. Therefore, in the case where ordinary hot-rolled steel 2 mm thick is used for the material of the guide rail 5, the tolerance is reduced to half of that of the guide rail 5 shown in FIG. 1 wherein the surface of the longitudinal leg 51 itself serves as the guide runner in the bracket 4. In another case where special cold-worked polished steel plate is used for the material of the guide rail 5, the tolerance is remarkably reduced to 0.08 mm, which compares favorably with that of the guide rail 5 described hereinbefore. Because of such a small tolerance in thickness, the folded edge 51' of the longitudinal leg 51 accurately fits into the groove 41' of the bracket 4 so that the lateral displacement of the window pane 6 with respect to the plane of the window pane 6 can be limited and the angular displacement of the window pane 6 can also be limited. Consequently, irregular upward and downward motion of the window pane can be prevented.

On the other hand, the bracket 4 is preferably formed integrally from molded synthetic resin. The first channel 41 is in the form of a substantially semicircular cross-sectioned groove embracing the outer surfaces 51*a*, 51*a*' of the longitudinal leg 51 and the folded edge 51' (guide runner) so as to permit sliding upward and downward motion of the bracket 4 along the guide rail 5. The bracket 4 may alternatively be formed of steel material except such first and second channel portions.

Figure 5:
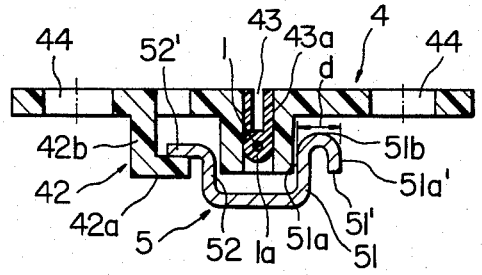
FIG. 5 is a cross-sectional view of the guiding arrangement of the wire-type door window regulator taken along the line Z—Z in FIG. 3.

As shown in FIG. 5 which shows a cross section taken along the line Z—Z of FIG. 3, the bracket 4 has the second channel 42 of a L-shaped cross section which is slidably engaged with a flange 52' formed by bending the edge of the other longitudinal leg 52 of the guide rail in the same way as described in the conventional door window regulator with reference to FIGS. 1 and 2.

Therefore, a combination of sliding contact between the folded surface 51*b* of the longitudinal leg 51 and the floor 41' of the grooved first channel 41 and sliding contact between the flange surface 52' and the L-shaped second channel 42 prevents displacement of the window pane 6 in the thickness direction thereof as denoted by C of FIG. 2.

In the same manner as described with reference to the conventional door window regulator shown in FIG. 2, an elastic member such as a leaf spring on end of which is folded backward may be inserted between the flange 52' and L-shaped second channel 42 so as to ensure smooth movement of the bracket 4.

Figure 6:
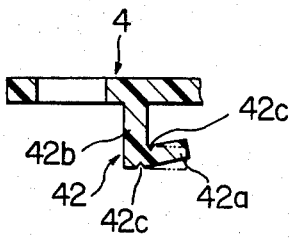
FIG. 6 is a side view of a bracket of the wire-type door window regulator partially showing a wire-type door window regulator of a second preferred embodiment according to the present invention.

In a second preferred embodiment, the contact member 42*a* of the L-shaped second channel 42 may be inclined at an acute angle with respect to a support leg 42b of the L-shaped second channel 42, as shown in FIG. 6. Furthermore, an integral hinge 42c is formed at the intersection between the contact member 42a and support leg 42b. The flange 52' of the guide rail 5 holds the sliding contact surface 42a at a right angle with respect to the support leg 42b by means of the integral hinge 42c as denoted by phantom lines in FIG. 6 after assembly of the door window regulator according to the present invention. Therefore, the elastic restoring force of the sliding contact member 42a itself ensures tight engagement with the flange 52' of the guide rail 5.

Since the integral hinge 42c is formed at the intersection of the L-shaped second channel, the elastic member as shown in FIG. 2 may not specifically be needed.

It should be noted that in FIGS. 3, 4, and 5 numeral 43 denotes a groove into which the wire 1 is inserted and the side wall of which includes a lock portion 43a to prevent movement of a stop 1a fixed to the wire 1. It should also be noted that numeral 44 denotes a hole for fixing the window pane 6 to the surface of the bracket 4.

As described hereinabove, a wire-type door window regulator wherein the edges of an elongated steel strip are bent to form a guide rail member having a substantially U-shaped cross section, the sides of the guide rail member being constructed so as to prevent displacement of a window pane of the door in lateral direction thereof and to prevent rotational displacement of the window pane, is characterized in that the edge of one longitudinal leg of the U-shaped guide rail member is folded backward to form an inverted U-shape folded portion so that the outer surface of the longitudinal leg and the extended outer surface of the inverted U-shape folded portion form a guide runner which prevent lateral and rotational movement of the window pane.

Consequently, dimensional variation in clearance between the guide runner of the guide rail and the corresponding grooved channel of the bracket can be reduced remarkably compared with the conventional door window regulator and irregular upward and downward movement of the window pane can be prevented. Additional advantages are that no special steel material with especially fine tolerance in thickness is required, the thickness of the material used for the guide rail can be reduced since the strength of the longitudinal leg is remarkably increased by folding the edge thereof, and a deburring operation on the edges of the guide rail can be eliminated so that manufacturing cost can be reduced.

It should be fully understood by those skilled in the art that various modifications and changes can be made in the preferred embodiment described above without departing the spirit and scope of the present invention, which is to be defined by the appended claims.

What is claimed is:

1. A door window regulator to which moves a window pane upwardly and downwardly relative to a door inner panel or a body panel of a vehicle, which comprises:

(a) a wire extending parallel to the direction of movement of the window pane;

(b) a wire driving mechanism to which the ends of said wire are secured and which winds and unwinds said wire according to the rotation thereof;

(c) a guide rail member, attached to the door inner panel or body panel and which extends in substantially the same direction as the motion of the window pane, having a longitudinal leg at each side thereof and the edge of one longiudinal leg being bent at a substantially right angle to form a flange and the edge of the other longitudinal leg being folded backward to form a substantially inverted U-shaped guide runner; and (d) a bracket for attaching the window pane to said wire having a first channel adapted for receiving said inverted U-shaped guide runner so that the window pane moves in the longitudinal direction of said guide rail member while preventing both lateral and rotational movements of the window pane, a second channel separated from said first groove for slidably engaging the flange of said guide rail member, the second channel of said bracket being formed of elements including a rigid support leg and flexible leg elastically urged in the direction of decreasing the width of the second channel, and a stop member for fixing the wire to said bracket, said bracket being attached to the window pane.

2. A door window regulator as set forth in claim 1, wherein said guide rail member is made of an elongated steel strip.

3. A door window regulator as set forth in claim 1, wherein the first channel of said bracket is formed in an inverted U-shape sectioned groove so as to embrace said inverted U-shaped guide runner to suppress the movement of said window pane along the thickness thereof together with said second bracket.

4. A door window regulator as set forth in claim 2, wherein the flange and guide runner of said guide rail member are formed by press working.

5. A door window regulator which operatively moves a window pane upwardly and downwardly relative to a door inner panel or a body panel of a vehicle, having wire means extending parallel to the direction of movement of the window pane and a driving mechanism which operatively moves said wire means along the direction of movement of the window panel, said door window regulator comprising:

(a) a guide rail member, attached to the door inner panel or body panel and extending in substantially the same direction as the motion of the window pane, having an inverted U-shaped cross-sectional area in a substantially vertical projection with respect to a body thereof extended along the window pane; and (b) a bracket member, to which a portion of said wire means extending along the direction of movement of the window pane is attached and a portion of the window pane is attached so that the window pane is moved relative to the door inner panel or body panel, having at least one U-shaped channel for receiving said inverted U-shaped cross sectional area of said guide rail member so that the window pane moves in the longitudinal direction of said guide rail member while preventing both lateral and rotational movements of the window pane.

6. The window regulator as set forth in claim 5, wherein said guide rail member further includes a bent edge having a substantially L-shaped cross section so as to form a flange and wherein said bracket member further includes another channel spaced apart from said first mentioned channel which slidably engages said bent edge surface of said guide rail member.

* * * * *